US007077112B2

(12) United States Patent
Mitani et al.

(10) Patent No.: US 7,077,112 B2
(45) Date of Patent: Jul. 18, 2006

(54) FUEL VAPOR LEAK DETECTING APPARATUS, AND FUEL SUPPLYING APPARATUS TO BE APPLIED TO THE SAME

(75) Inventors: Tateki Mitani, Tokyo (JP); Shigeki Kanamaru, Tokyo (JP); Hiroshi Yoshioka, Tokyo (JP); Kazushi Ishii, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/771,458

(22) Filed: Feb. 5, 2004

(65) Prior Publication Data

US 2004/0154596 A1 Aug. 12, 2004

(30) Foreign Application Priority Data

Feb. 7, 2003 (JP) ..... P. 2003-030598
Mar. 14, 2003 (JP) ..... P. 2003-069396

(51) Int. Cl.
*F02M 25/08* (2006.01)

(52) U.S. Cl. ..... 123/518; 123/519; 123/520

(58) Field of Classification Search ..... 123/520, 123/518, 519, 516, 198 D
See application file for complete search history.

(56) References Cited

U.S. PATENT DOCUMENTS 5,146,902 A * 9/1992 Cook et al. ..... 123/518
5,215,061 A * 6/1993 Ogawa et al. ..... 123/478
5,273,020 A * 12/1993 Hayami ..... 123/520
5,297,529 A * 3/1994 Cook et al. ..... 123/520
5,390,645 A * 2/1995 Cook et al. ..... 123/520
5,411,004 A * 5/1995 Busato et al. ..... 123/520
5,450,834 A * 9/1995 Yamanaka et al. ..... 123/520
5,553,577 A * 9/1996 Denz et al. ..... 123/198 D
5,890,474 A * 4/1999 Schnaibel et al. ..... 123/520
6,112,728 A 9/2000 Schwegler et al.

FOREIGN PATENT DOCUMENTS

JP 2001-012319 A 1/2001

* cited by examiner

*Primary Examiner*—Thomas Moulis
(74) *Attorney, Agent, or Firm*—Sughrue Mion, PLLC

(57) ABSTRACT

A fuel vapor leak detecting apparatus, includes: a valve which is in a vapor purge system including a canister that is communicated with a fuel tank and an internal combustion engine, and which controllably closes the vapor purge system; a pressurizing section which introduces atmospheric air into the vapor purge system to pressurize the vapor purge system; and an internal-pressure measuring section which detects an internal pressure of the vapor purge system. The pressurizing section supplies the air for a predetermined time in a state where the vapor purge system is closed. When the internal pressure measured by the internal-pressure measuring section at the air supply is equal to or lower than a preset criterion pressure, it is judged that leak occurs.

16 Claims, 9 Drawing Sheets

FUEL VAPOR LEAK DETECTING APPARATUS, AND FUEL SUPPLYING APPARATUS TO BE APPLIED TO THE SAME

BACKGROUND OF THE INVENTION

1. Field of the Invention

The present invention relates to a fuel vapor leak detecting apparatus of an internal combustion engine for a vehicle.

2. Background Art

A conventional fuel vapor leak detecting apparatus is configured so that, after an internal combustion engine is stopped, pressurized air is supplied from an air pump to a purge line and a fuel tank, and a leak amount is judged on the basis of the operating current of a motor for driving the air pump (for example, see JP-A-2001-12319 (pages 2 to 6, FIG. 1)).

A conventional fuel vapor leak detecting apparatus has a configuration in which, after an internal combustion engine is stopped, an air pump is driven to supply pressurized air to a purge line and a fuel tank, and a leak amount is judged on the basis of the operating current of a motor for driving the air pump. Therefore, the apparatus requires the air pump, the driving motor, and peripheral pipes, and hence has a complicated structure. Since the internal pressure of the purge line and the fuel tank is indirectly measured on the basis of the operating current of the motor for driving the air pump, the judgment accuracy is limited. The air pump must be operated until the internal pressure reaches a predetermined level. The leak detection is performed after the internal combustion engine is stopped. Therefore, problems in that a battery is consumed, and that the operation of the air pump for detecting leak produces an unpleasant sound are caused.

SUMMARY OF THE INVENTION

The invention has been conducted in order to solve the problems. It is an object of the invention to provide a fuel vapor leak detecting apparatus which has a simplified structure configured by a reduced number of components, and which leak detection can be accurately performed even during an operation of an internal combustion engine.

The fuel vapor leak detecting apparatus of the invention includes: a valve which is in a vapor purge system including a canister and a fuel tank, and which controllably closes the vapor purge system; a pressurizing section which introduces atmospheric air into the vapor purge system; and an internal-pressure measuring section which measures the internal pressure of the vapor purge system. When the internal pressure at a timing when the pressurizing section supplies the air for a predetermined time in a state where the vapor purge system is closed is equal to or lower than a predetermined criterion, or the internal pressure and the pressure rise rate are equal to or lower than predetermined criteria, the apparatus judges that leak occurs.

BRIEF DESCRIPTION OF THE DRAWINGS

The present invention may be more readily described with reference to the accompanying drawings.

DETAILED DESCRIPTION OF THE PREFERRED EMBODIMENTS

Embodiment 1.

Figure 1:
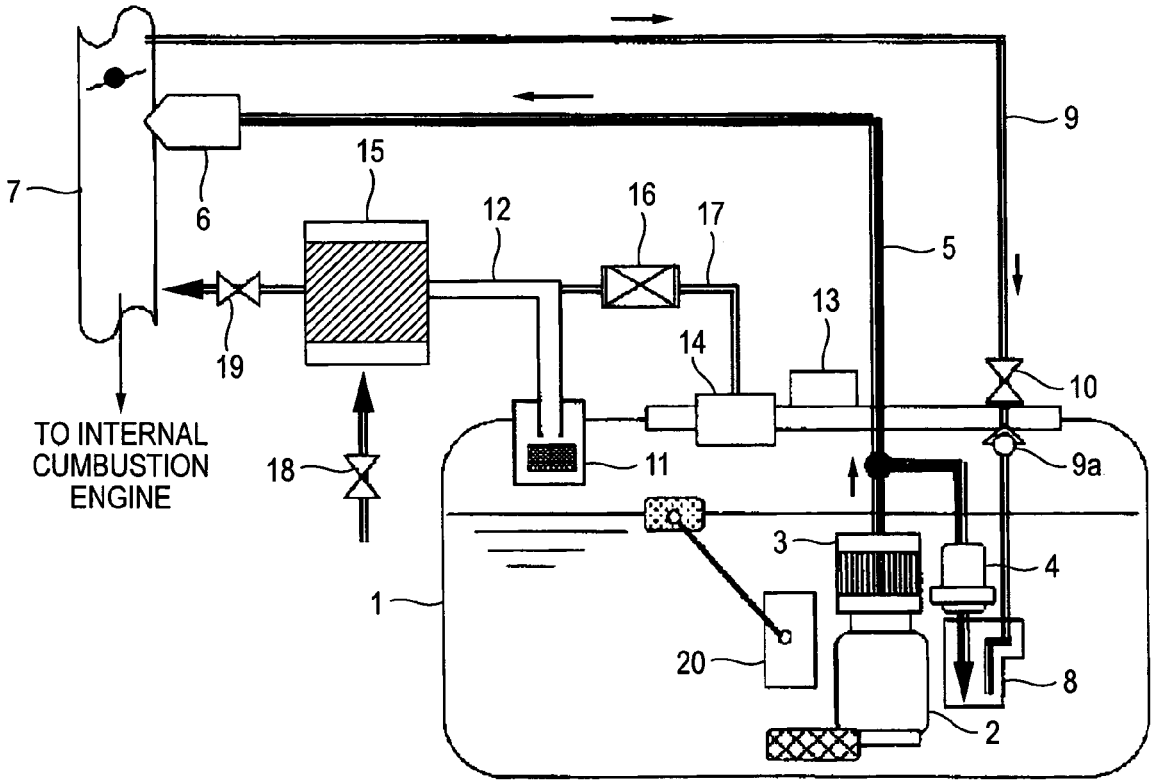
FIG. 1 is a diagram of a fuel vapor leak detecting apparatus of Embodiment 1 of the invention.
Figure 2:
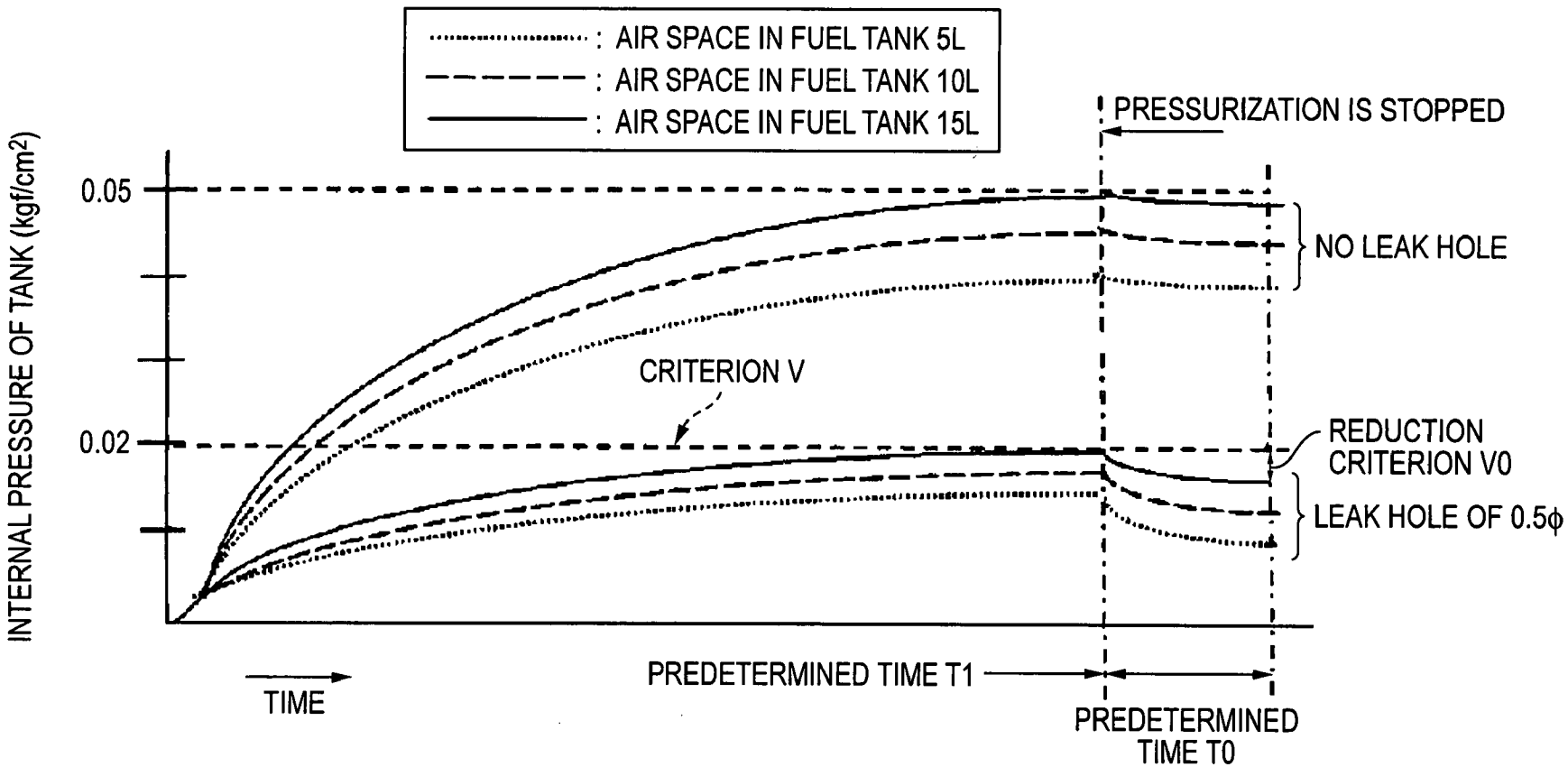
FIG. 2 is a graph showing rising states of the internal pressure of a fuel tank depending on the presence or absence of a leak hole in Embodiment 1.

FIG. 1 is a diagram of a fuel vapor leak detecting apparatus of Embodiment 1 of the invention, and FIG. 2 is a graph showing rising states of the internal pressure of a fuel tank depending on the presence or absence of a leak hole.

Referring to FIG. 1, gasoline which is supplied from a fuel pump 2 disposed in a fuel tank 1 is passed through a strainer and filter assembly 3, adjusted to have a constant pressure by a pressure regulator 4, and then supplied to an injector 6 through a fuel pipe 5. Thereafter, the fuel is injected from the injector 6 into an intake manifold 7 to be burned in an internal combustion engine which is not shown.

A jet pump 8 which serves as a pressurizing section for the fuel tank 1 is disposed in a discharge port of the pressure regulator 4 branching off from the fuel pipe 5. One end of an air inlet pipe 9 is connected to the jet pump 8, and the other end of the air inlet pipe 9 communicates with the atmospheric air outside the fuel tank 1 through a check valve 9*a* and a control valve 10. In the embodiment, in order to obtain clean air, the air inlet pipe 9 is connected to the intake manifold 7 upstream from the injector 6. The jet pump 8 sucks atmospheric air by means of the Venturi effect due to a flow of gasoline.

In the fuel tank 1, a vent valve 11 is attached to an inner upper portion, and an internal-pressure sensor 13 which measures the pressure difference between the interior of the fuel tank land the ambient, and a rollover valve 14 which closes in an abnormal state such as a vehicle rollover are attached to a portion which is not immersed in gasoline. The vent valve 11 and a vent path 12 communicate with a canister 15. The vent path 12 is used for discharging to a canister 15 air containing gasoline vapor which is pushed out during a process of refueling the fuel tank 1. When the fuel level reaches the vicinity of the full level, the vent valve 11 closes the vent path 12.

A vapor path 17 elongates from the rollover valve 14 to the canister 15 through a two-way valve 16. The canister 15 is connected to the intake manifold 7. A valve B19 which opens and closes the connection between the intake manifold 7 and the canister 15, and a valve A 18 which opens and closes the connection between the canister 15 and the ambient are disposed. The valve A 18 and the valve B 19 are opened or closed as needed so that gasoline vapor in a vapor purge system adhering to the canister 15 is sent to the internal combustion engine through the intake manifold 7 by means of the air suction from the valve A 18. A fuel level gauge 20 which detects the fuel level is disposed in the fuel tank 1.

The control valve 10, the valve A 18, the valve B 19, and the internal-pressure sensor 13 are connected to a CPU of a fuel injection controlling apparatus. The CPU controls the opening and closing operations of the valves, and the sensing operations of the internal-pressure sensor 13 and the fuel level gauge 20.

In the thus configured fuel vapor leak detecting apparatus, when leak detection is to be performed, all the components of the vapor purge system such as the valve A 18 and the valve B 19 are closed, and the control valve 10 which is usually closed to block the function of the jet pump 8 is then opened, thereby causing the jet pump 8 to operate.

In order to stabilize the pressurizing force of the jet pump 8, preferably, the above is conducted during the internal combustion engine is stopped, or during an idling operation of the internal combustion engine in which the engine consumes a less amount of gasoline and the gasoline flow to the jet pump 8 can be ensured.

During an idling operation of the internal combustion engine, gasoline supplied from the fuel pump 2 is adjusted to the constant pressure by the pressure regulator 4, a very small portion of the gasoline is then sent to the internal combustion engine, and the major portion of the gasoline flows into the jet pump 8 through the pressure regulator 4, so that the jet pump 8 sucks atmospheric air to pressurize the interior of the fuel tank 1. The internal-pressure sensor 13 monitors the pressure state due to the pressurization, and it is judged whether leak occurs in the vapor purge system including the fuel tank 1, the vent path 12, and the canister 15 or not. The amount of leak through a hole of 0.5 mm is used as the reference in the judgment on presence of leak.

FIG. 2 is a graph showing rises of the internal pressure of the fuel tank which were obtained by experiments while changing the presence/absence of a leak hole of 0.5 mm, and the air space (the capacity excluding the amount of gasoline) in the fuel tank. From the graph, it will be understood that the saturation pressure and the time to reach saturation are largely varied depending on whether a leak hole exists or not.

The case where the air space in the fuel tank is 15 liters will be considered. Although the internal pressure of the fuel tank 1 depends on the suction ability of the jet pump 8, it will be seen that, in the case of no leak, the internal pressure is approximately saturated at about 160 sec. after beginning of the operation of the fuel pump 2, and, in the case of a leak hole of 0.5 mm, the internal pressure is saturated by a lower pressure at an earlier timing.

When the sucking and pressurizing ability of the jet pump 8 serving as a pressurizing section is constant, the pressure rise rate of the fuel tank 1 depends on the air space in the fuel tank and the temperature of the interior of the fuel tank. Therefore, a correction table in which the air space and the temperature are used as parameters is prepared from the results of FIG. 2. The value of the fuel level gauge 20 indicating the remaining amount of gasoline in the tank, and an output of a temperature sensor in the fuel tank are supplied to the CPU, so that the pressure rise rate is corrected to one in the standard state (in which the air space in the fuel tank is 15 liters and the tank temperature is 30° C.). Thereafter, it is judged whether leak occurs or not.

The correction is based on the air space of the tank instead of the remaining amount of gasoline, in order to eliminate the influence of the variation in full capacity depending on the fuel tank type.

Next, judgment methods in the leak detection in Embodiment 1 will be described.

First, the pressure at a timing when the pressurization is performed for a predetermined time in the case where a leak hole of 0.5 mm exists in the standard state is set as a criterion V. The criterion is previously stored into a memory device of the CPU. The predetermined time is adequately set in accordance with a time which is required for saturation depending on the ability of the pressurizing section.

In a first judgment method, during an idling operation of the internal combustion engine, pressurization is started at a timing when all the components of the vapor purge system such as the valve A 18 and the valve B 19 are closed and the control valve 10 is opened in response to a leak judgment start command from the CPU.

The pressurization is performed for the predetermined time T1. The detection value of the internal-pressure sensor 13 at this timing is corrected in accordance with the values of the temperature sensor and the fuel level gauge 20. The corrected pressure is compared with the criterion V which is previously stored. If the pressure >the criterion V, it is judged that "no leak, normal state," and, if the pressure <the criterion V, an alarm of "leak occurs" is given. Thereafter, the leak detection is ended.

Alternatively, when the detection value of the internal-pressure sensor 13 exceeds the criterion before the predetermined time T1 elapses, it may be judged that "no leak, normal state," and the leak detection may be then ended.

In the above, the presence/absence of leak is judged on the basis of only the pressure rise. Alternatively, in order to enhance the judgment accuracy, the judgment may be performed with further considering also the pressure reduction state. In the alternative, after the pressurization is performed for the predetermined time T1 by the jet pump 8 for saturating the internal pressure, the control valve 10 is closed to block the function of the jet pump 8, and the pressure reduction state is detected by the internal-pressure sensor 13. If the internal pressure fails to reach the criterion V after the pressurization for the predetermined time T1, it is judged that "leak occurs."

If the absolute value of the reduced pressure of the internal pressure after an elapse of a predetermined time T0 from the stop of the function of the jet pump 8 is smaller than a reduction criterion V0, it is judged that "no leak, normal state." If the pressure reduction is larger than the reduction criterion V0, the alarm of "leak occurs" is given. Thereafter, the leak detection is ended. When the judgment based on the pressure rise and that based on the internal pressure reduction are combined with each other, correct leak judgment is enabled.

In a second judgment method, in the same manner as described above, during an idling operation of the internal combustion engine, all the components of the vapor purge system such as the valve A 18 and the valve B 19 are closed, and the control valve 10 is opened to operate the jet pump 8, thereby pressurizing the interior of the fuel tank 1.

Figure 3:
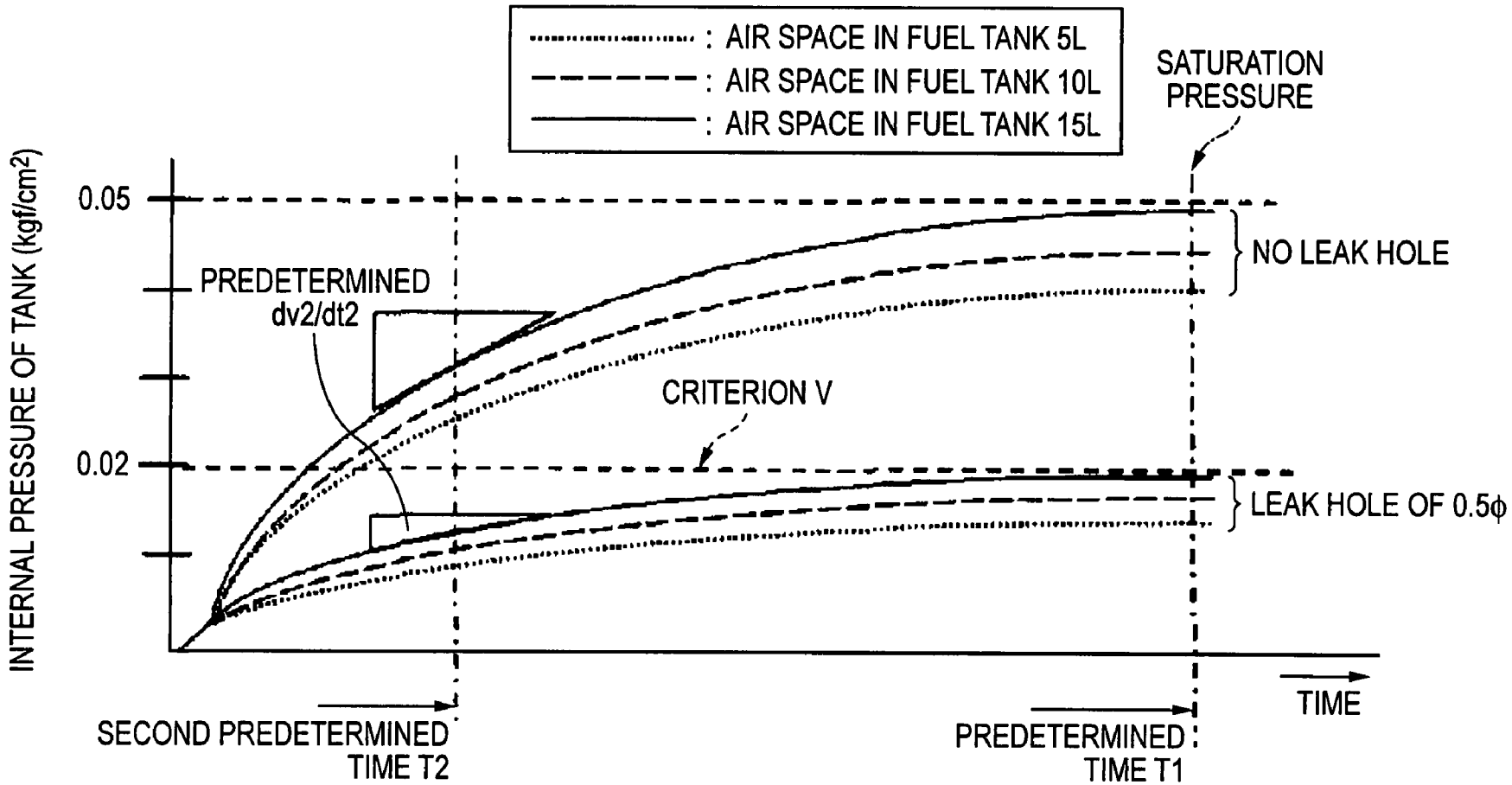
FIG. 3 is a graph showing rising states of the internal pressure of a fuel tank in leak detection depending on the presence or absence of a leak hole in Embodiment 1.

Referring to FIG. 3, the point (the time from the beginning of the leak detection) where the difference between the pressure rise rate of a case where a leak hole of 0.5 mm exists, and that of a case of no leak hole is largest before saturation is attained is obtained from the graph of experimental results. From results of experiments by the inventors, it has been found that the difference in pressure rise rate (dv/dt) is large during about ¼ to ⅓ (second predetermined time T2) of the predetermined time T1 required for attaining saturation.

First, the pressure rise rate obtained when the pressurization is performed for the second predetermined time T2 in the case where a leak hole of 0.5 mm exists in the standard state (in which the air space in the tank is 15 liters and the tank temperature is 30° C.) is previously stored as a predetermined pressure rise rate (dv2/dt2) into the CPU.

In the leak detection judgment, the CPU obtains the detected pressure of the internal-pressure sensor 13 as a moving average pressure rise rate for several seconds (5 seconds), and corrects the obtained rate to a moving average pressure rise rate in the standard state on the basis of the value of the fuel level gauge 20 and the output of the temperature sensor at the leak detection judgment. Since the detected pressure of the internal-pressure sensor 13 is set as a moving average for several seconds, several seconds after beginning of the pressurization in which the pressure rise rate is most unstable can be eliminated from the detection object, and an influence of an irregular pressure for a short time can be reduced.

The presence/absence of leak is judged by comparing the moving average pressure rise rate in the standard state with the predetermined pressure rise rate (dv2/dt2). If the moving average pressure rise rate which is obtained by the internal-pressure sensor 13 at an elapse of the second predetermined time T2 and corrected by the CPU exceeds the predetermined pressure rise rate (dv2/dt2), it is judged that "no leak, normal state." If the corrected moving average pressure rise rate at an elapse of the second predetermined time T2 is equal to or smaller than the predetermined pressure rise rate (dv2/dt2), the alarm of "leak occurs" is given. Thereafter, the leak detection is ended.

As described above, the presence/absence of leak is judged on the basis of the pressure rise rate at an elapse of the second predetermined time T2 after the beginning of the leak detection. Therefore, the time required for leak detection can be shortened.

In the fuel vapor leak detecting apparatus of Embodiment 1, the vapor purge system including the fuel tank 1 and the canister 15 is pressurized by introducing atmospheric air by the pressurizing section such as the jet pump 8, and the presence/absence of leak is judged on the basis of the internal pressure of the fuel tank 1 after an elapse of the predetermined time. Therefore, the presence/absence of leak can be judged in a short time, and hence leak detection can be performed during an idling operation of the internal combustion engine.

In the first and second judgment methods described above, the leak detecting operation is performed during an idling operation of the internal combustion engine. Alternatively, in the same manner as the conventional apparatus, the fuel pump 2 may be driven in the state where, after the internal combustion engine is stopped, the valve A 18, the valve B 19, and the like are closed, and the control valve 10 is opened. In this case also, leak detection can be performed.

In the leak detection method to be performed after the internal combustion engine is stopped, the pressurizing force of the jet pump 8 is stabilized irrespective of the amount of gasoline consumed by the engine, and hence leak detection can be accurately performed. In this case, however, the battery voltage for driving the fuel pump 2 must be stabilized, and the CPU must set the temperature-locked state in order to enable the leak detecting operation to be performed only when the engine cooling water temperature is equal to or higher than a constant temperature. The temperature-locked state is canceled under the conditions that the internal combustion engine is operated for a period when the engine cooling water is at the constant temperature or higher, that the battery is charged during the period, and the battery voltage is stabilized.

Embodiment 2.

Figure 4:
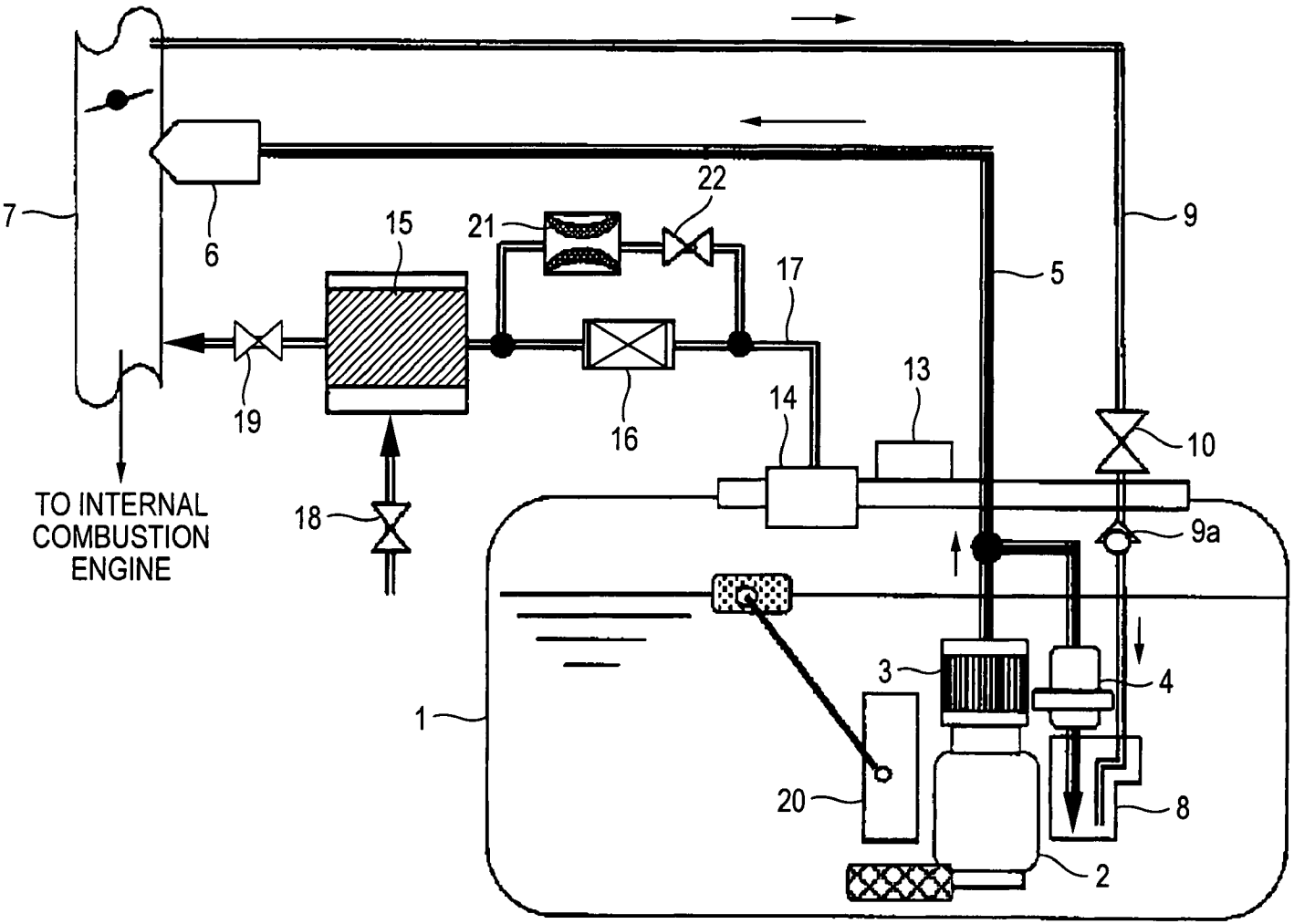
FIG. 4 is a diagram of a fuel vapor leak detecting apparatus of Embodiment 2 of the invention.
Figure 5:
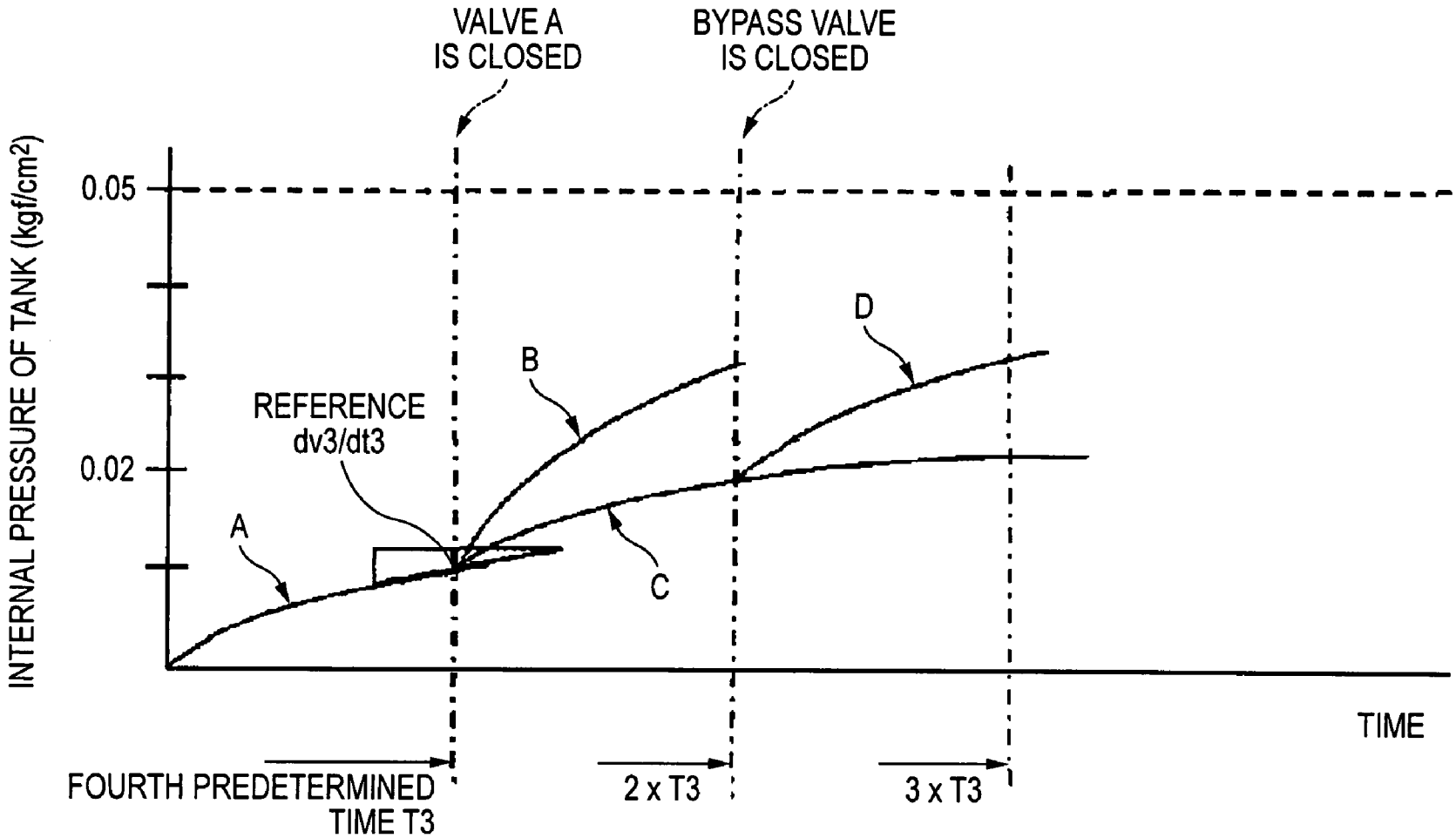
FIG. 5 is a graph showing states of the internal pressure in leak detection in Embodiment 2.

FIG. 4 is a diagram of a fuel vapor leak detecting apparatus of Embodiment 2 of the invention, and FIG. 5 is a graph showing states of the internal pressure in leak detection in Embodiment 2.

In the figures, 1 to 20 denote the components identical with those of Embodiment 1. Embodiment 2 is applied to a tank apparatus in which the vent valve 11 is not used, a bypass valve 22 is disposed in parallel to the two-way valve 16, and a reference Orifice 21 is disposed in series to the path of the bypass valve 22. The reference orifice 21 has an opening which corresponds to the leak hole diameter of 0.5 mm for judging the presence/absence of leak in an opened state of the bypass valve 22, and through which the interior of the fuel tank 1 communicates with the canister 15. The CPU can control the opening and closing operations of the bypass valve 22. When the bypass valve 22 is opened, the interior of the fuel tank 1 can communicate with the canister 15 irrespective of the operating pressure of the two-way valve 16.

A judgment method in the leak detection in Embodiment 2 will be described. In Embodiment 1, the first and second judgment methods have been described. In order to avoid confusion, although in Embodiment 2, the method is called a third judgment method in accordance with the numerical order.

In the third judgment method, during an idling operation of the internal combustion engine, the control valve 10, the bypass valve 22, and the valve A 18 are opened, and the valve B 19 is closed in response to the leak judgment start command from the CPU. The major portion of the gasoline from the fuel pump 2 flows into the jet pump 8 through the pressure regulator 4, so that the jet pump 8 sucks atmospheric air by the negative pressure generated by the flow, to pressurize the interior of the fuel tank 1.

The pressurized air in the fuel tank 1 is caused by the pressurization by the jet pump 8 to be discharged from the valve A 18 to the atmosphere through the reference orifice 21 and the canister 15.

During the initial stage of the beginning of pressurization, the pressurized air is discharged to the atmosphere through the reference orifice 21. When no leak occurs in the fuel tank 1, therefore, the pressure state of the fuel tank 1 is as indicated by the curve A shown in FIG. 5. The curve is a reference pressure rise curve in the case where a leak hole of 0.5 mm exists. The pressure at a timing when a third predetermined time T3 (about 10 seconds) when the pressure rise rate is largely varied depending on whether a leak hole exists or not elapses after the beginning of the leak detection, and a reference rise rate (dv3/dt3) according to the moving average are stored into the CPU. Then, the valve A 18 is closed. When the pressure and the pressure rise rate at a timing when the third predetermined time T3 further elapses (about 20 seconds after the beginning of the leak detection) are as indicated by the graph curve B which is higher than the pressure and the reference rise rate (dv3/dt3) that have been stored, it is judged that the whole vapor purge system is in "no leak, normal state," and the leak detection is ended.

When the pressure and the pressure rise rate at a timing when the third predetermined time T3 elapses after the closing of the valve A 18 (about 20 seconds after the beginning of the leak detection) remain unchanged or are equal to or smaller than the graph curve C in which the increment is very small, an alarm that "leak occurs" in the vapor purge system is given, and the bypass valve 22 is closed. The very small increment is used in order to further consider an efficient for judging leak on the side of the fuel tank 1 which will be described later.

When the pressure and the pressure rise rate at a timing when the third predetermined time T3 further elapses (about 30 seconds after the beginning of the leak detection) after the closing of the bypass valve 22 are as indicated by the graph curve D which is higher than the pressure and the reference rise rate (dv3/dt3) that have been stored, it is judged that the system on the side of the fuel tank 1 is normal, an alarm that "leak occurs" on the side of the canister 15 is given, and the leak detection is completed.

When the pressure rise rate at the timing when the third predetermined time T3 further elapses (about 30 seconds after the beginning of the leak detection) after the closing of the bypass valve 22 can be regarded on the extension of the graph curve C of the case where the pressure rise rate is smaller than the reference rise rate (dv3/dt3), an alarm that "leak occurs" on the side of the fuel tank 1 is given, and the leak detection is completed.

When no leak exists on the side of the fuel tank 1, the reference rise rate (dv3/dt3) is determined by the reference orifice 21, and functions as the reference of the leak amount irrespective of the temperature of the fuel tank and the amount of gasoline in the fuel tank at the timing of leak detection. Therefore, leak detection can be accurately performed while eliminating the necessity of the fuel level gauge 20 and correction by the temperature of the interior of the fuel tank.

In the pressurization of the third predetermined time T3, when leak exists on the side of the fuel tank 1, leak occurs in both the reference orifice 21 and the leak hole of the fuel tank 1, and hence the pressure rise rate is smaller than the reference rise rate (dv3/dt3). Therefore, while assuming leak on the side of the fuel tank 1, the pressure rise rate in the case where two reference orifices 21 are disposed in parallel is experimentally obtained, and the small-increment graph curve C which is multiplied with a coefficient for converting to a pressure rise rate corresponding to one leak hole is set as the judgment object.

When there is no leak on the side of the fuel tank 1, the pressure rise rate after the bypass valve 22 is closed is larger than the increment in which the conversion coefficient is considered. Therefore, it is sufficiently possible to judge that there is no leak on the side of the fuel tank 1.

The interval between the opening/closing operations of the valves and the detection of presence/absence of leak is set to an integer multiple of the third predetermined time T3 for the following reason. The air space in the fuel tank is changed by a small degree for a short time, and the pressurizing conditions under which the pressure rise rate is to be obtained are made identical.

In the third judgment method, leak detection can be performed for a short time, and it is possible to identify the leak position, or on the side of the fuel tank 1 or on the side of the canister 15.

In Embodiments 1 and 2, the jet pump 8 which is driven by the gasoline flow from the fuel pump 2 is used as the pressurizing section. Therefore, it is not required to separately install a power source serving as the pressurizing section, so that the apparatus can be simplified and made economical.

Embodiment 3.

Figure 6:
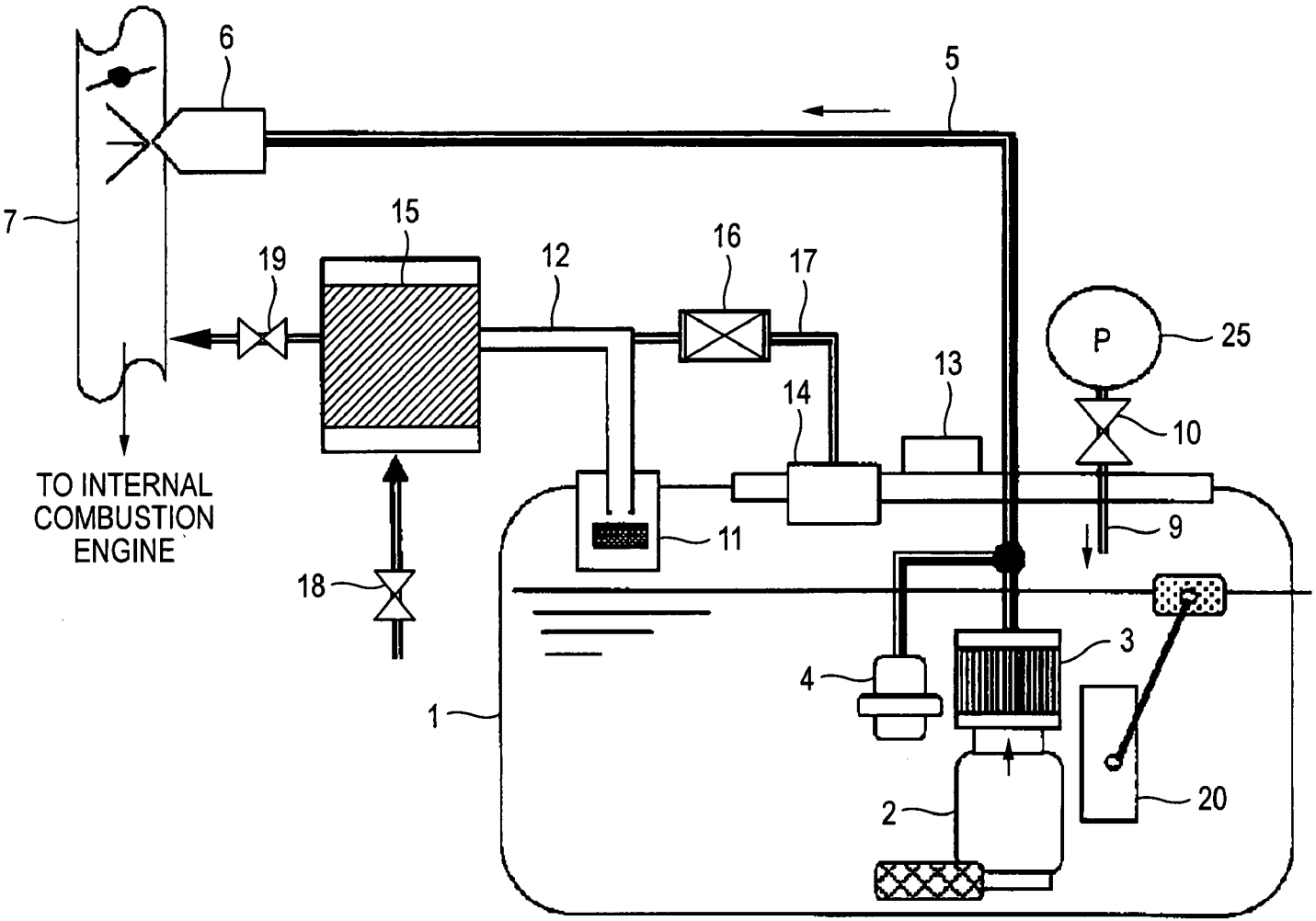
FIG. 6 is a diagram of a fuel vapor leak detecting apparatus of Embodiment 3 of the invention.

FIG. 6 is a diagram of a fuel vapor leak detecting apparatus of Embodiment 3 of the invention. In the figure, 1 to 20 denote the components identical with those of Embodiment 1.

In Embodiments 1 and 2, the jet pump 8 which is driven by the gasoline flow from the fuel pump 2 is used as the section for pressurizing the interior of the fuel tank 1. Alternatively, an air pump 25 which is disposed outside the fuel tank 1 may be used as the pressurizing section.

It is apparent that any one of the leak detection methods according to Embodiments 1 and 2 can be applied as a method of controlling the valves and detecting leak.

Embodiment 4.

Figure 7:
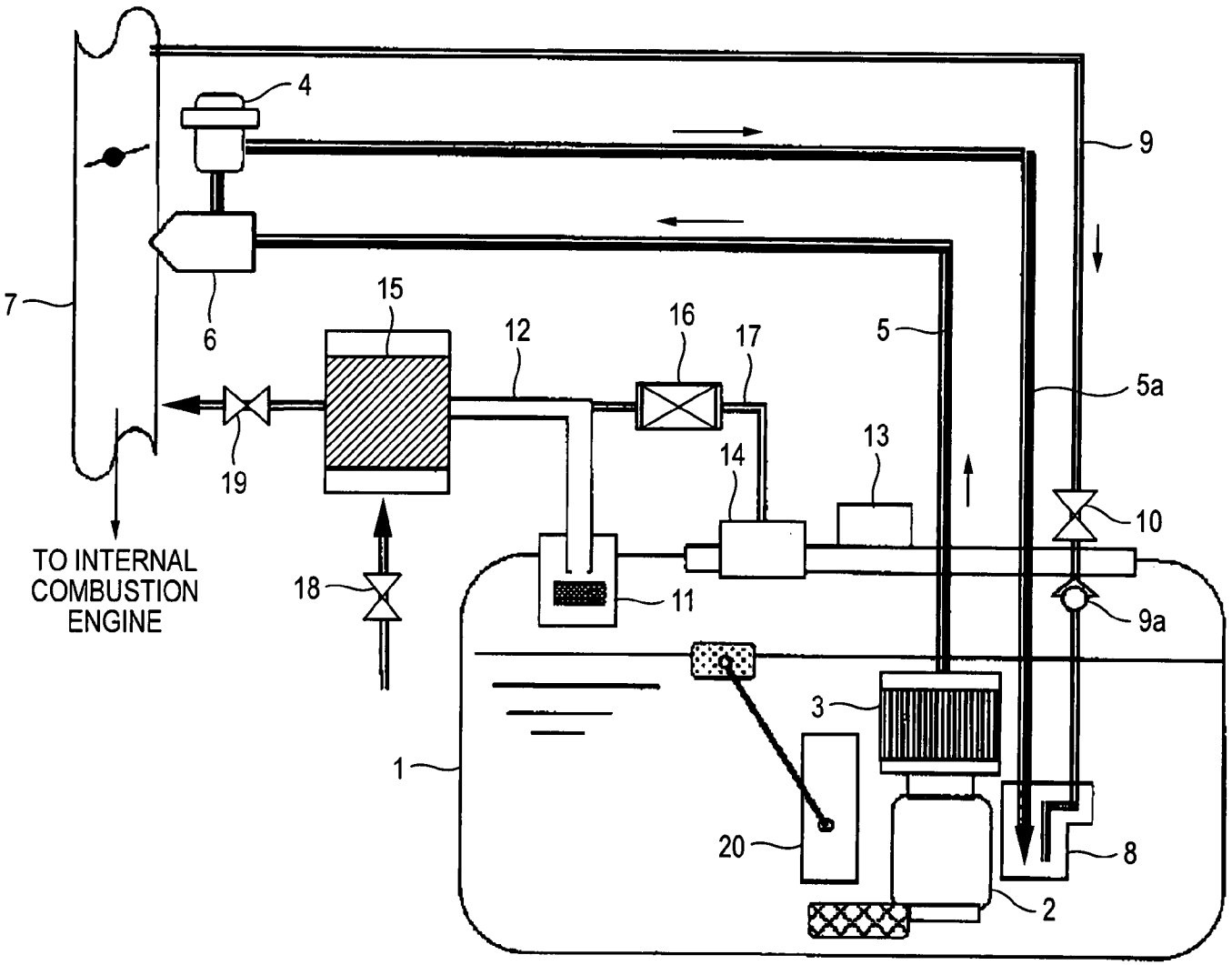
FIG. 7 is a diagram of a fuel vapor leak detecting apparatus of Embodiment 4 of the invention.

FIG. 7 is a diagram of a fuel vapor leak detecting apparatus of Embodiment 4 of the invention. In the figure, 1 to 20 denote the components identical with those of Embodiment 1.

In Embodiment 4, the pressure regulator 4 is disposed outside the fuel tank 1, and excess gasoline which has not been consumed by the injector 6 is returned to the fuel tank 1 through a return pipe 5*a*. The forward end of the return pipe 5*a* is connected to the jet pump 8, so that atmospheric air is sucked from the air inlet pipe 9 by a flow of excess gasoline to pressurize the interior of the fuel tank 1. Any one of the first to fourth leak detection methods which have been described above can be applied in the judgment of the presence/absence of leak.

Embodiment 5.

Figure 8:
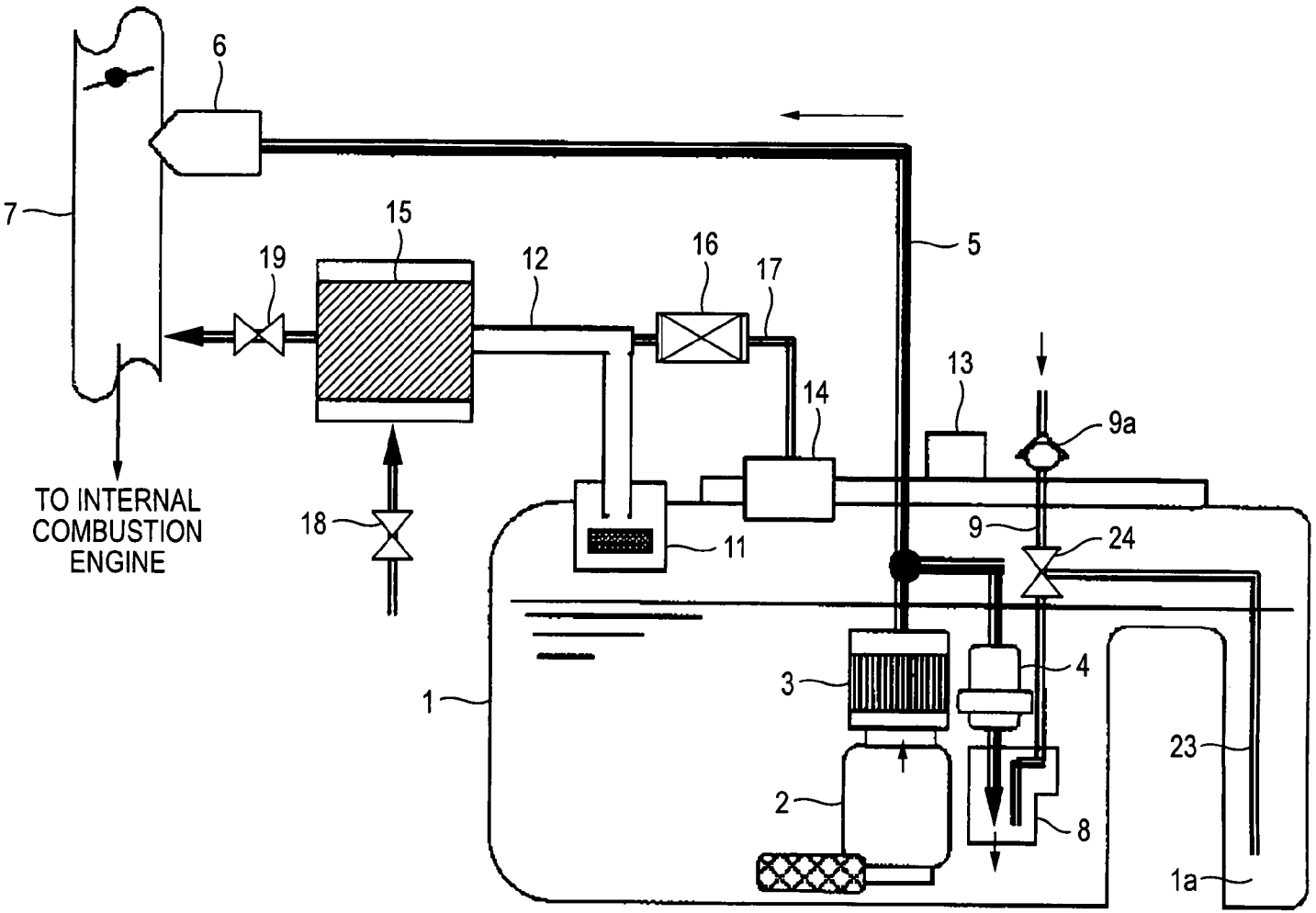
FIG. 8 is a diagram of a fuel vapor leak detecting apparatus of Embodiment 5 of the invention.

FIG. 8 is a diagram of a fuel vapor leak detecting apparatus of Embodiment 5 of the invention. In the figure, 1 to 19 denote the components identical with those of Embodiment 1.

In a four-wheel drive vehicle or the like having a fuel tank 1 of the saddle type, a jet pump 8 is already disposed in order to transfer gasoline from another chamber 1*a* to the fuel tank 1 over the saddle portion.

In Embodiment 5, the existing jet pump 8 is used as the pressurizing section for the fuel tank 1. The flow path of a fuel transfer pipe 23 is switched over by a three-way valve 24. The air inlet pipe 9 branches off from a portion of the fuel transfer pipe 23 close to the jet pump 8 to communicate with the atmospheric air through the check valve 9*a*.

Usually, the three-way valve 24 forms a flow path from the other chamber 1*a* so that gasoline in the other chamber 1*a* of the saddle type fuel tank is transferred by the negative pressure of the jet pump 8 due to the driving of the fuel pump 2. When leak is to be detected, the three-way valve 24 is switched in response to a command from the CPU so as to perform suction through the air inlet pipe 9. Thereafter, the valve A 18 and the valve B 19 are opened or closed in accordance with any one of the above-described detection methods, and the presence/absence of leak is judged. Any one of the leak detection methods according to the above-described Embodiments 1–4 can be applied.

In Embodiment 5, since the jet pump 8 for transferring gasoline in the other chamber 1*a* of the saddle type tank serves also as the pressurizing section, the apparatus can be economically configured.

Embodiment 6.

Figure 9:
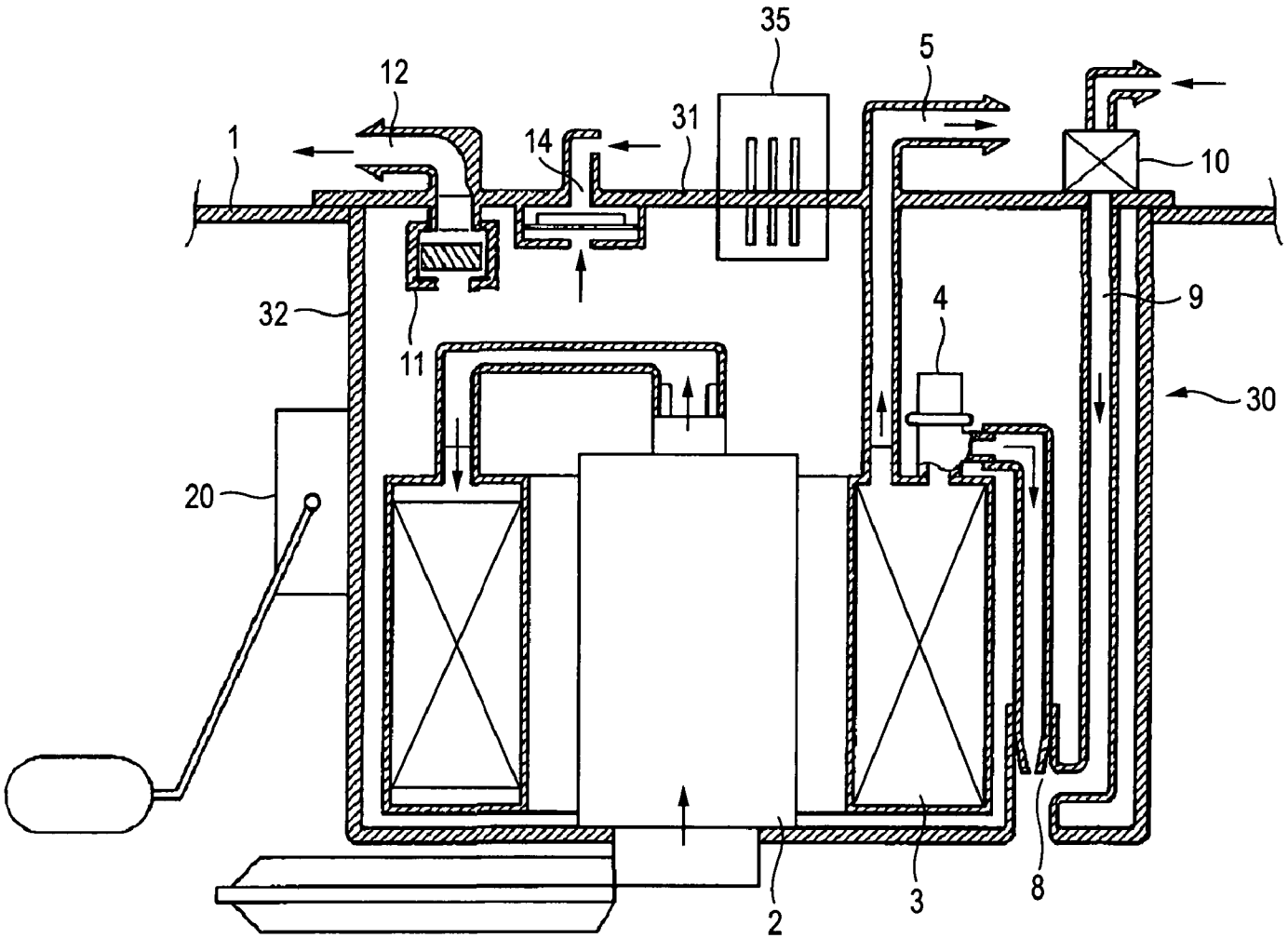
FIG. 9 is a diagram of a fuel supplying apparatus which is to be used in the fuel vapor leak detecting apparatus of the invention.

FIG. 9 is a diagram of a fuel supplying apparatus which is to be used in the fuel vapor leak detecting apparatus of the invention. In the figure, the reference numerals identical with those used in the above description denote similar components.

In the fuel supplying apparatus 30, components are mounted on a flange 31 which is to be attached to an opening formed in the fuel tank 1. The fuel filter 3, the fuel level gauge 20, and the fuel pump 2 are mounted on a support member 32 extending from the flange 31. The pressure regulator 4 is attached to the fuel filter 3. A part of the fuel pipe 5 for supplying gasoline to the internal combustion engine, and an outlet port for the air inlet pipe 9 are disposed in the flange 31. The check valve 9*a* and the control valve 10 are placed in the air inlet pipe 9. The internal-pressure sensor 13, the rollover valve 14, and an electrical connector 35 are mounted on the flange.

The discharge port of the pressure regulator 4 branching off from the fuel filter 3 is connected to the jet pump 8. Wirings from the fuel pump 2, the control valve 10, the air inlet pipe 9, the internal-pressure sensor 13, the fuel level gauge 20, and like components can be connected to the CPU or a power source battery through the electrical connector 35.

Since the fuel pump 2, the components of the gasoline supply system, and those required in the fuel vapor leak detecting apparatus are integrated with the fuel supplying apparatus 30, the fuel vapor leak detecting apparatus can be miniaturized and easily mounted in a vehicle.

As described above, according to the invention, a fuel tank is closed, the interior of the fuel tank is pressurized by the pressurizing section such as a jet pump, and the pressurizing state is measured and monitored in terms of time by an internal-pressure sensor, thereby enabling the presence/absence of leak in a gasoline vapor purge system to be judged by a simple system during an operation of a vehicle. Furthermore, a system for detecting leak in a vapor purge system can be economically configured.

What is claimed is:

1. A fuel vapor leak detecting apparatus, comprising:

a valve which is in a vapor purge system including a canister that is communicated with a fuel tank and an internal combustion engine, and which controllably closes the vapor purge system;

a pressurizing section which introduces atmospheric air into the vapor purge system to pressurize the vapor purge system; and an internal-pressure measuring section which detects an internal pressure of the vapor purge system;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that a leak occurs, and wherein the pressurizing section is a jet pump using a gasoline flow from a fuel pump which is submerged in the fuel tank.

2. The fuel vapor leak detecting apparatus according to claim 1, wherein an elapsed time from beginning of pressurization to a timing when a difference in pressure rise rate between two pressure rise curves becomes large is set as a second predetermined time, the two pressure rise curves being respectively in cases where a leak hole corresponding to the leak criterion exists, and where a leak does not occur;

a pressure rise rate at a timing of an elapse of the second predetermined time in the case where a leak hole exists is previously stored as a predetermined pressure rise rate; and, when a pressure rise rate in a case where the pressurizing section performs pressurization for the second predetermined time in a state where the vapor purge system is closed is equal to or smaller than the predetermined pressure rise rate, it is judged that a leak occurs.

3. The fuel vapor leak detecting apparatus according to claim 1, further comprising: a gasoline remaining amount grasping section which detects at least a remaining amount of gasoline in the fuel tank;

wherein the leak criterion is corrected on the basis of the remaining amount of gasoline detected by the gasoline remaining amount grasping section.

4. A fuel vapor leak detecting apparatus, comprising:

a bypass valve which is openable and closable, which is in a vapor purge system including a canister that is communicated with a fuel tank and an internal combustion engine, and which bypasses a two-way valve interposed between the fuel tank and the canister;

a reference orifice which is connected in series to the bypass valve;

a communication valve which controls communication between the canister and an ambient area;

a pressurizing section which introduces atmospheric air into the fuel tank; and an internal-pressure measuring section which detects an internal pressure of the fuel tank;

wherein a reference pressure rise rate at a timing when the pressurizing section supplies the air for a second predetermined time in a state where the communication valve and the bypass valve are opened is set, and, when a pressure rise rate at a timing when a time which is twice the second predetermined time has elapsed after the communication valve is closed is equal to or smaller than the reference pressure rise rate, it is judged that a leak occurs.

5. The fuel vapor leak detecting apparatus according to claim 4, wherein a reference pressure rise rate at a timing when the pressurizing section supplies the air for the second predetermined time in a state where the communication valve and the bypass valve are opened is set;

when a pressure rise rate at a timing when a time which is twice the second predetermined time has elapsed after the communication valve is closed is equal to or smaller than the reference pressure rise rate, the bypass valve is closed; and, when a pressure rise rate at a timing when a time which is thrice the second predetermined time has elapsed after the bypass valve is closed is equal to or larger than the reference pressure rise rate, it is judged that a leak occurs on a side of the canister, and, when the pressure rise rate at the timing is smaller than the reference pressure rise rate, it is judged that a leak occurs on a side of the fuel tank.

6. The fuel vapor leak detecting apparatus according to claim 4, further comprising: a gasoline remaining amount grasping section which detects at least a remaining amount of gasoline in the fuel tank;

wherein the leak criterion is corrected on the basis of the remaining amount of gasoline detected by the gasoline remaining amount grasping section.

7. The fuel vapor leak detecting apparatus according to claim 4, wherein the pressurizing section includes an air pump.

8. The fuel vapor leak detecting apparatus according to claim 4, wherein the pressurizing section is a jet pump using a gasoline flow from a fuel pump which is submerged in the fuel tank.

9. The fuel vapor leak detecting apparatus according to claim 4, wherein the pressurizing section is a jet pump using a discharge flow from a pressure regulator which adjusts a pressure of gasoline supplied from a fuel pump submerged in the fuel tank to the internal combustion engine.

10. The fuel vapor leak detecting apparatus according to claim 4, wherein the pressurizing section is a jet pump using a flow of return gasoline which is a residual as a result of consumption of gasoline in the internal combustion engine, the gasoline being supplied from a fuel pump submerged in the fuel tank to the internal combustion engine.

11. The fuel vapor leak detecting apparatus according to claim 4, wherein a jet pump which transfers gasoline from another chamber of a saddle type fuel tank by a flow of excess gasoline from the fuel pump is caused to function as the pressurizing section by, when a leak is detected, switching a suction portion of the jet pump to a pipe for introducing atmospheric air.

12. A fuel vapor leak detecting apparatus, comprising:

a valve which is in a vapor purge system including a canister that is communicated with a fuel tank and an internal combustion engine, and which controllably closes the vapor purge system;

a pressurizing section which introduces atmospheric air into the vapor purge system to pressurize the vapor purge system; and an internal-pressure measuring section which detects an internal pressure of the vapor purge system;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that a leak occurs, wherein an elapsed time from beginning of pressurization to a time when a difference in a pressure rise rate between two pressure rise curves becomes large is set as a second predetermined time, the two pressure rise curves being respectively in cases where a leak hole corresponding to leak criterion exists, and where a leak hole does not exist, a pressure rise rate at a timing of an elapse of the second predetermined time in the case where a leak hole exists is previously stored as a predetermined pressure rise rate, and, when a pressure rise rate in a case where the pressurizing section performs pressurization for the second predetermined time in a state where the vapor purge system is closed is equal to or smaller than the predetermined pressure rise rate, it is judged that a leak occurs.

13. A fuel vapor leak detecting apparatus, comprising:

a valve which is in a vapor purge system including a canister that is communicated with a fuel tank and an internal combustion engine, and which controllably closes the vapor purge system;

a pressurizing section which introduces atmospheric air into the vapor purge system to pressurize the vapor purge system; and an internal-pressure measuring section which detects an internal pressure of the vapor purge system;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that a leak occurs, and wherein the pressurizing section is a jet pump using a discharge flow from a pressure regulator which adjusts a pressure of gasoline supplied from a fuel pump submerged in the fuel tank to the internal combustion engine.

14. A fuel vapor leak detecting apparatus, comprising:

a valve which is in a vapor purge system including a canister that is communicated with a fuel tank and an internal combustion engine, and which controllably closes the vapor purge system;

a pressurizing section which introduces atmospheric air into the vapor purge system to pressurize the vapor purge system; and an internal-pressure measuring section which detects an internal pressure of the vapor purge system;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that leak occurs, and wherein the pressurizing section is a jet pump using a flow of return gasoline which is residual as a result of consumption of gasoline in the internal combustion engine, the gasoline being supplied from a fuel pump submerged in the fuel tank to the internal combustion engine.

15. A fuel vapor leak detecting apparatus, comprising:

a valve which is in a vapor purge system including a canister that is communicated with a fuel tank and an internal combustion engine, and which controllably closes the vapor purge system;

a pressurizing section which introduces atmospheric air into the vapor purge system to pressurize the vapor purge system; and an internal-pressure measuring section which detects an internal pressure of the vapor purge system;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that leak occurs, and wherein the fuel tank is a saddle type fuel tank and a jet pump is provided which transfers gasoline from a chamber of the saddle type fuel tank by a flow of excess gasoline from a fuel pump, the jet pump functions as the pressurizing section by, when a leak is detected, switching a suction portion of the jet pump to a pipe for introducing atmospheric air.

16. A fuel vapor leak detecting apparatus, comprising:

a valve which is in a vapor purge system including a canister that is communicated with a fuel tank and an internal combustion engine, and which controllably closes the vapor purge system;

a bypass valve which is openable and closable, and which bypasses a two-way valve interposed between the fuel tank and the canister;

a pressurizing section which introduces atmospheric air into the vapor purge system to pressurize the vapor purge system;

an internal-pressure measuring section which detects an internal pressure of the vapor purge system;

a reference orifice which is connected in series to the bypass valve; and a communication valve which controls communication between the canister an ambient area;

wherein the pressurizing section supplies the air for a predetermined time in a state where the vapor purge system is closed, and, when the internal pressure measured by the internal-pressure measuring section at the air supply is equal to or lower than a preset criterion pressure, it is judged that a leak occurs, wherein the pressurizing section is a jet pump using a gasoline flow from a fuel pump which is submerged in the fuel tank, wherein a reference pressure rise rate at a timing when the pressurizing section supplies the air for a second predetermined time in a state where the communication valve and the bypass valve are opened is set, and when a pressure rise rate at a timing when a time which is twice the second predetermined time has elapsed after the communication valve is closed is equal to or smaller than the reference pressure rise rate, it is judged that a leak occurs.

* * * * *